US005255833A

United States Patent [19]

McAllister

[11] Patent Number: 5,255,833

[45] Date of Patent: Oct. 26, 1993

[54] TRANSPARENT CARRIER

[76] Inventor: Rosalie McAllister, 219-24 121st Ave., Cambria Heights, N.Y. 11411

[21] Appl. No.: 854,472

[22] Filed: Mar. 17, 1992

[51] Int. Cl.[5] ..... A45F 3/02

[52] U.S. Cl. ..... 224/202; 224/205; 224/236; 224/257; 150/110; 150/128

[58] Field of Search ..... 224/205, 202, 228, 235-237, 224/257; 150/103, 110, 119, 127-130, 107, 118; 190/100, 115, 124, 126, 902, 903; D3/100, 42-44, 45-46, 51-53, 33, 79

[56] References Cited

U.S. PATENT DOCUMENTS

| | | | |
|---|---|---|---|
| D. 273,941 | 5/1984 | Farber | D3/52 |
| 2,278,271 | 3/1942 | Laitman | 150/127 |
| 2,334,410 | 11/1943 | Hume | 150/127 |
| 2,428,682 | 10/1947 | Rhodes | 150/129 |
| 2,475,277 | 7/1949 | Budnik | 150/118 |
| 2,701,222 | 2/1955 | Hetzel et al. | 190/903 |
| 2,822,013 | 2/1958 | Renz | 190/126 |
| 3,870,132 | 3/1975 | Hanley | 190/109 |
| 5,009,319 | 4/1991 | Jantzen | 150/129 |

*Primary Examiner*—Henry J. Recla
*Assistant Examiner*—Robert A. Goldman
*Attorney, Agent, or Firm*—Lalos & Keegan

[57] ABSTRACT

An apparatus for carrying personal articles comprising a substantially rectangular container portion of transparent plastic material having continuous front, bottom, rear and top surfaces, closure means between the top and front surfaces for closing the container portion, a flexible shoulder strap adapted to be received over the head and one arm of the wearer, the shoulder strap being dimensioned so as to continuously extend from one end of the bottom surface over the shoulder of the wearer to the opposite end of the bottom surface and adapted to lay flat against the body of the wearer, and attaching means for attaching the shoulder strap to the ends of the surfaces of the container portion. The shoulder strap has a pair of wide portions at either end extending from the bottom surface to an upper edge of the front and rear surfaces and having first and second edges, a narrow portion extending around the head of the wearer having first and second edges, and a pair of transitionary portions extending from the wide portions to each end of the narrow portion, each of the transitionary portion having a first edge disposed in angular relationship with first edge of the wide portion and a second edge disposed in linear relationship with the second edges of the wide and narrow portions.

10 Claims, 2 Drawing Sheets

TRANSPARENT CARRIER

BACKGROUND OF THE INVENTION

This invention relates to transparent carriers, and more particularly, to carriers which can be worn by uniformed personnel.

Uniformed personnel, such as police officers or postal workers, must typically comply with strict uniform codes. Such codes often prohibit the use of such items as a handbag, backpack, or briefcase unless it is issued as part of the uniform or is transparent.

A number of uniformed personnel perform tasks which require them to be away from an office or an automobile for a period of time as part of their employment. Such personnel often have a need to carry personal items with them when performing such tasks at a remote location. Unfortunately, these employees are limited in their options for carrying such items by the uniform codes. Additionally, when such personnel are performing tasks which require physical activity, a carrier is likely to inhibit movement and cause personal discomfort.

Accordingly, it is an object of the present invention to provide an improved carrier.

Another object of the present invention is to provide an improved carrier for uniformed personnel.

A further object of the invention is to provide an improved transparent carrier for personal items.

A still further object of the invention is to provide an improved transparent carrier which meets the requirements of a uniform code.

Another object of the invention is to provide an improved carrier which does not interfere with the movements of the wearer.

A still further objective of the present invention is to provide an improved carrier which is adapted to fit snugly to the wearer's body so as not to impede motion.

Other objects and advantages of the present invention will become more apparent to those persons having ordinary skill in the art to which the present invention pertains from the following description taken in conjunction with the accompanying drawings.

DESCRIPTION OF THE PREFERRED EMBODIMENTS

Figure 1:
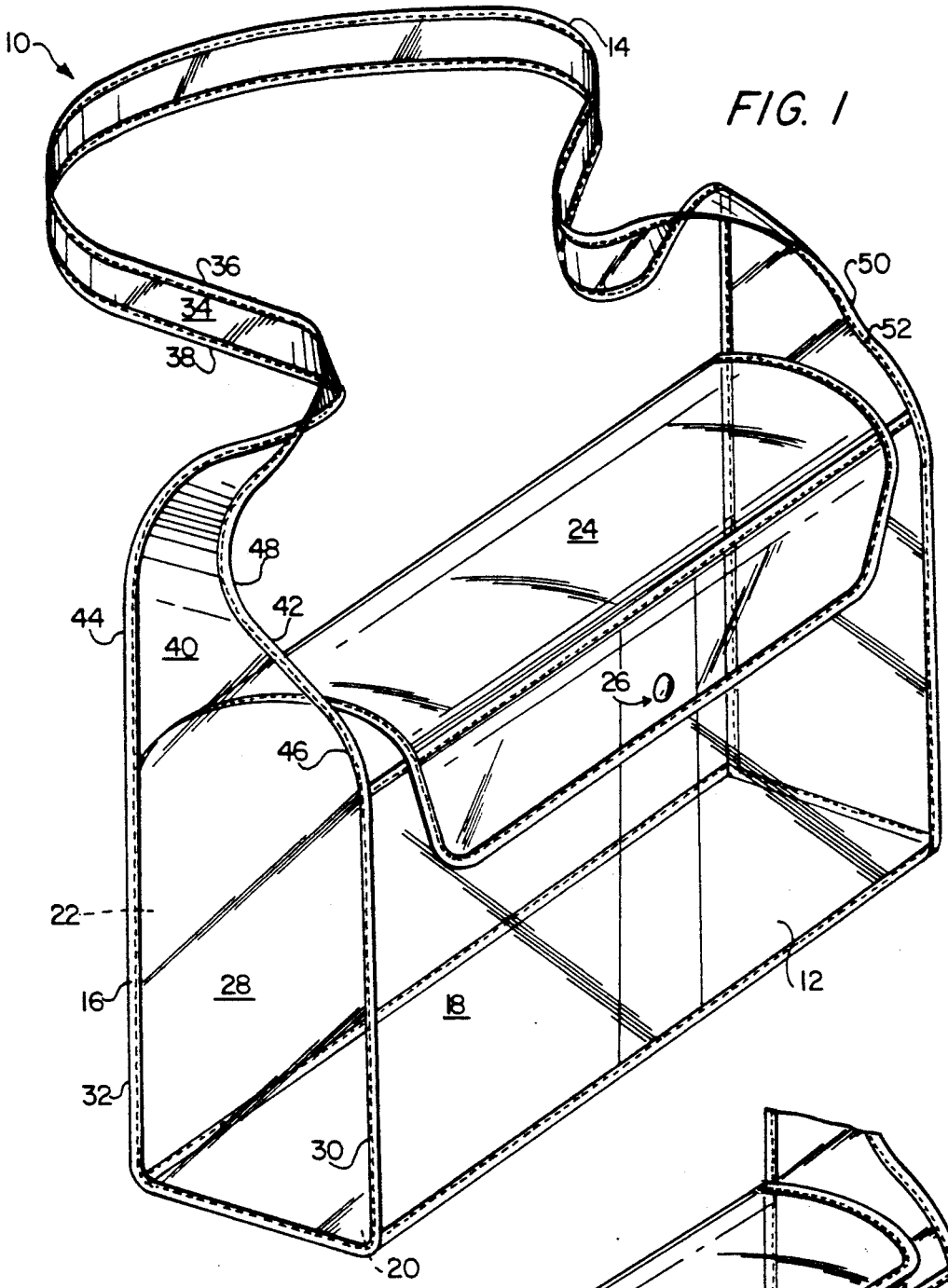
FIG. 1 is a perspective view of the preferred embodiment of the present invention.

Referring to the illustration of the present invention as shown in FIGS. 1–4, the carrier, shown generally as 10, includes a substantially rectangular container portion 12, a flexible shoulder strap 14, and attaching means 16 for attaching shoulder strap 14 to container portion 12. Container portion 12 is of transparent plastic material and has front, bottom, rear and top surfaces 18, 20, 22 and 24, respectively. Rear surface 22 and top surface 24 are continuous and formed of one piece of material. Alternatively, the front, bottom, rear and top surfaces may all be continuous. Top surface 24 further extends toward front surface 18 and the top and front surfaces are held together by closure means 26, thereby allowing container portion 12 to be closed.

Shoulder strap 14 is adapted to be received over the head and one arm of the wearer as best shown in FIG. 1 and is dimensioned so as to extend from one edge of bottom surface 20 over the head and shoulder of the wearer to the opposite edge of bottom surface 20. Shoulder strap 14 is also adapted to lay flat against the body of the wearer as will be described in greater detail herein.

In order to effectuate the shoulder strap being flat against the wearer's body, shoulder strap 14 is preferably dimensioned as follows. Shoulder strap 14 has a pair of wide portions 28 at either end extending from bottom surface 20 to an upper edge of front and rear surfaces 18 and 22. Wide portion 28 further has first and second edges 30 and 32, respectively. Shoulder strap 14 also has a narrow portion 34 extending around the shoulder of the wearer, also having first and second edges 36 and 38, respectively. Extending between each wide portion 28 and one end of narrow portion 34 is a transitionary portion 40 again having first and second edges 42 and 44. First edges 30, 36 and 42 are located at the forward portion of shoulder strap 14. Conversely, second edges 32, 38 and 44 are located at the rearward portion of shoulder strap 14. First edge 42 of transitionary portion 4 is disposed in angular relationship with first edge 30 of wide portion 28. Additionally, second edge 44 of transitionary portion 40 is disposed in linear relationship with second edges 32 and 38 of said wide and narrow portions.

Transitionary portion 40 further includes a convex curved edge 46 disposed between first edge 4 of transitionary portion 40 and first edge 30 of wide portion 28. Similarly, a concave curved edge 48 is disposed between first edge 42 of transitionary portion 40 and first edge 36 of narrow portion 34.

Figure 4:
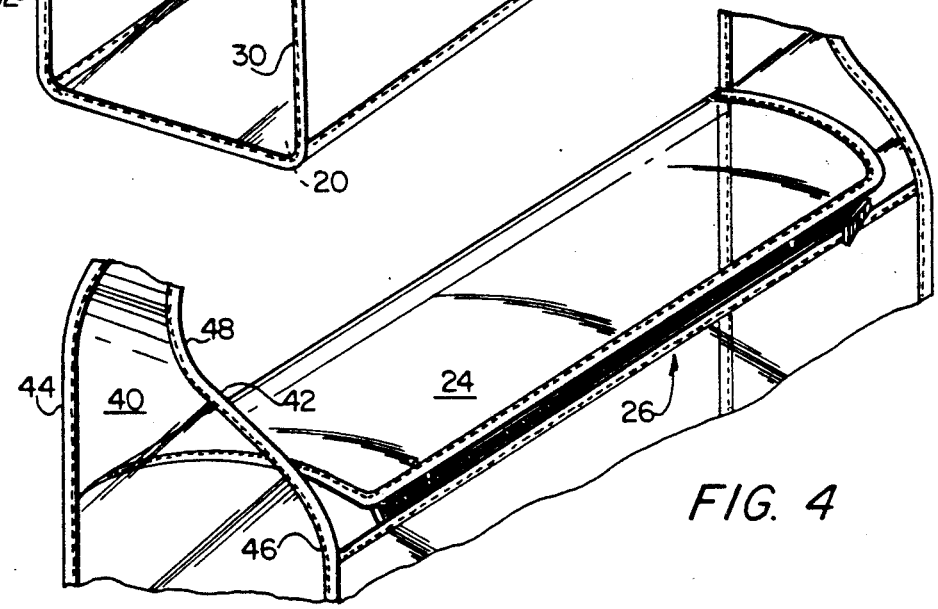
FIG. 4 is a perspective view of an alternate embodiment of the present invention.
Figure 3:
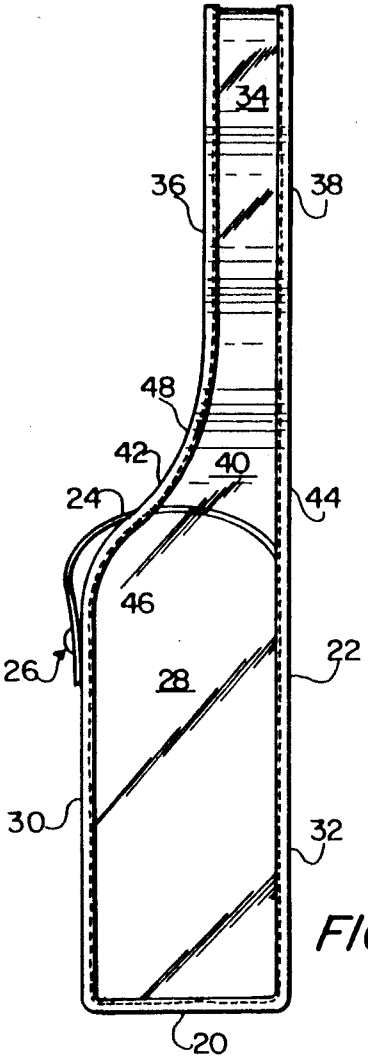
FIG. 3 is a side view of the embodiment shown in FIGS. 1 and 2.
Figure 2:
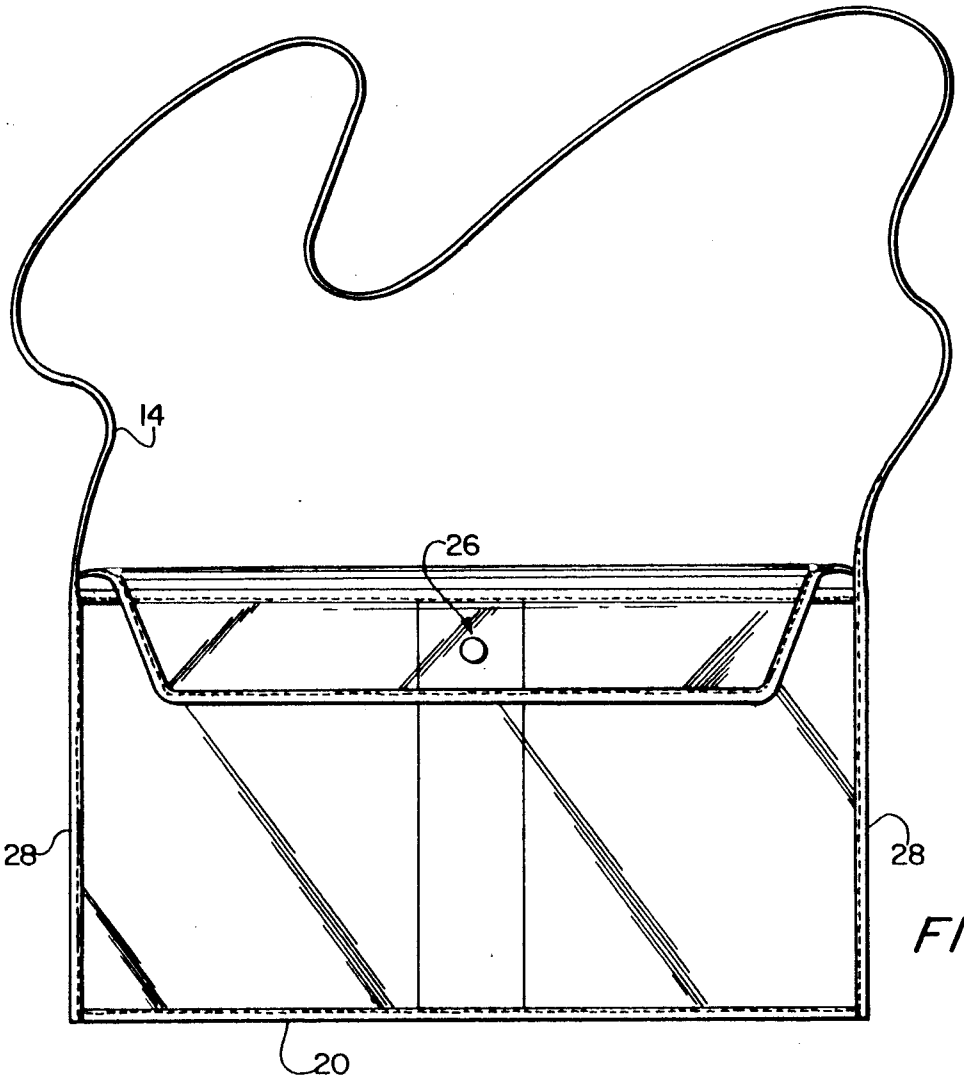
FIG. 2 is a front view of the embodiment of FIG. 1.

In a preferred embodiment, closure means 26 comprises either a snap closure as shown in FIGS. 1–3 or a zipper as shown in FIG. 4. Attaching means 16 comprises a strip 50 of transparent plastic material folded over the edges of surfaces 18, 20 and 22 and securing means 52 for securing said strip to said end surfaces. Securing means 52 can be any conventional method of securing two materials together, for instance, stitches. Alternatively, attaching means 16 can comprise permanent sealing of the edges of said surfaces.

From the foregoing detailed description, it will be evident that there are a number of changes, adaptations and modifications of the present invention which come within the province of those having ordinary skill in the art to which the aforementioned invention pertains. However, it is intended that all such variations not departing from the spirit of the invention be considered as within the scope thereof, limited solely by the appended claims.

I claim:

1. An apparatus for carrying personal articles of a wearer comprising:

a substantially rectangular container portion of transparent plastic material having front, bottom, rear and top surfaces, each of said surfaces having side edges;

closure means between said top and front surfaces for closing said container portion;

a flexible shoulder strap, adapted to be received over the head and one arm of the wearer, said shoulder strap being dimensioned so as to continuously extend from one end of said bottom surface over the shoulder of the wearer to an opposite end of said bottom surface and adapted to lay flat against the body of the wearer; and attaching means for attaching said shoulder strap to said side edges of said front, bottom, and rear surfaces of said container portion;

said shoulder strap including a wide portion at each end thereof and extending from said bottom surface to an upper edge of said front and rear surfaces, each wide portion including first and second edges, a narrow portion adapted to extend around the head of the wearer including first and second edges, and a pair of transitionary portions, each transitionary portion extending from one of said wide portions to one end of said narrow portion, each transitionary portion including a first edge disposed in an angular relationship with respective said first edges of each said wide portion and said narrow portion, and a second edge disposed in a straight line relationship with respective said second edges of each said wide portions and said narrow portion.

2. An apparatus according to claim 1 wherein each said transitionary portion further includes a convex curved edge disposed between said first edge of said transitionary portion and said respective first edges of each said wide portion.

3. An apparatus according to claim 1 wherein each said transitionary portion further includes a concave curved edge disposed between said first edge of said transitionary portion and said first edge of said narrow portion.

4. An apparatus according to claim 1 wherein said rear and top surfaces are continuous.

5. An apparatus according to claim 1 wherein said front, bottom, rear and top surfaces are continuous.

6. An apparatus according to claim 1 wherein said closure means comprises a snap fastening.

7. An apparatus according to claim 1 wherein said closure means comprises a zipper.

8. An apparatus according to claim 1 wherein said attaching means comprises a strip of transparent plastic material folded over the edges of said surfaces and securing means for securing said strip to said side edges of said surfaces.

9. An apparatus according to claim 8 wherein said securing means comprises stitches.

10. An apparatus according to claim 1 wherein said attaching means comprises permanent sealing of the side edges of said surfaces.

* * * * *